US010950997B2

(12) United States Patent
Dambach et al.

(10) Patent No.: US 10,950,997 B2
(45) Date of Patent: Mar. 16, 2021

(54) PLUG MODULE SYSTEM

(71) Applicant: Molex, LLC, Lisle, IL (US)

(72) Inventors: Philip J. Dambach, Naperville, IL (US); Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/546,563

(22) PCT Filed: Jan. 27, 2016

(86) PCT No.: PCT/US2016/015098
§ 371 (c)(1),
(2) Date: Jul. 26, 2017

(87) PCT Pub. No.: WO2016/123204
PCT Pub. Date: Aug. 4, 2016

(65) Prior Publication Data

US 2018/0026413 A1 Jan. 25, 2018

Related U.S. Application Data

(60) Provisional application No. 62/108,276, filed on Jul. 27, 2015.

(51) Int. Cl.

| | |
|---|---|
| ***H01R 31/00*** | (2006.01) |
| ***H01R 13/627*** | (2006.01) |
| ***H01R 13/6461*** | (2011.01) |
| ***H01R 24/62*** | (2011.01) |
| ***H01R 24/60*** | (2011.01) |
| *H01R 107/00* | (2006.01) |

(52) U.S. Cl.
CPC ..... *H01R 31/005* (2013.01); *H01R 13/6275* (2013.01); *H01R 13/6461* (2013.01); *H01R 24/60* (2013.01); *H01R 24/62* (2013.01); *H01R 2107/00* (2013.01)

(58) Field of Classification Search
CPC ..... H01R 31/005; H01R 13/6275; H01R 16/6461
USPC ..... 439/638
See application file for complete search history.

(56) References Cited

U.S. PATENT DOCUMENTS

| | | | | |
|---|---|---|---|---|
| 5,549,488 A | | 8/1996 | Berndt et al. | |
| 5,966,487 A | * | 10/1999 | Gilliland | G02B 6/3869 385/139 |
| 6,738,474 B1 | | 5/2004 | Miller | |
| 7,195,404 B1 | * | 3/2007 | Dudley | G02B 6/4201 385/92 |
| 7,238,049 B1 | * | 7/2007 | Wu | H01R 23/6873 439/607.27 |

(Continued)

FOREIGN PATENT DOCUMENTS

| | | |
|---|---|---|
| CN | 87100361 A | 8/1987 |
| CN | 102650978 A | 8/2012 |

(Continued)

*Primary Examiner* — Alexander Gilman

(57) ABSTRACT

A plug module is provided that includes a first mating end and a second mating end. The first mating end is configured to mate with a predefined port, such as a QSFP port. The second mating end can support two or more micro receptacles that allow the plug module to provide an octopus-like cable assembly without requiring the predetermination of a particular length of cable.

20 Claims, 21 Drawing Sheets

(56) References Cited

U.S. PATENT DOCUMENTS 7,258,264 B2 * 8/2007 Ice ..... G02B 6/4246 228/178
7,309,250 B2 * 12/2007 Reed ..... H01R 13/6275 439/352
7,416,436 B2 * 8/2008 Togami ..... G02B 6/4277 439/484
7,438,565 B2 10/2008 Hamazaki
7,452,139 B2 * 11/2008 Wang ..... G02B 6/3887 385/89
7,540,755 B1 * 6/2009 Wu ..... H01R 13/6275 439/352
7,594,766 B1 * 9/2009 Sasser ..... G02B 6/4246 385/139
7,625,240 B2 * 12/2009 Hayden, Sr. ..... H01R 13/64 439/637
7,941,053 B2 * 5/2011 Dallesasse ..... H04B 10/40 398/135
7,959,467 B2 * 6/2011 Sasser ..... H01R 13/6583 439/607.19
8,083,417 B2 * 12/2011 Aronson ..... G02B 6/3817 385/14
8,083,547 B2 * 12/2011 Roth ..... G02B 6/3817 439/607.1
8,121,139 B2 * 2/2012 Sunaga ..... G02B 6/4246 370/423
8,186,891 B2 * 5/2012 Hudgins ..... H04B 10/075 385/92
8,267,712 B2 * 9/2012 Huang ..... H01R 43/26 439/344
8,267,718 B2 * 9/2012 Straka ..... H01R 13/6471 439/497
8,417,119 B2 * 4/2013 Shimoosako ..... H04Q 11/0067 398/58
8,469,608 B2 * 6/2013 Kurashima ..... G02B 6/4201 361/818
8,526,810 B2 * 9/2013 Cole ..... H04B 10/0775 398/10
8,573,857 B2 * 11/2013 Hoffmann ..... G02B 6/3821 385/78
8,740,473 B2 * 6/2014 Katoh ..... G02B 6/3885 385/53
8,807,846 B2 * 8/2014 Hung ..... G02B 6/12 385/14
8,858,095 B2 * 10/2014 Meng ..... G02B 6/4292 385/93
9,001,515 B2 * 4/2015 Tang ..... H01R 13/6335 361/728
9,083,130 B2 * 7/2015 Casher ..... H01R 12/724
9,235,013 B1 * 1/2016 Chan ..... G02B 6/3893
9,312,618 B2 * 4/2016 Regnier ..... H01R 12/71
9,320,160 B2 * 4/2016 Dudemaine ..... H01R 13/46
9,341,795 B2 * 5/2016 Luo ..... G02B 6/428
9,419,403 B2 * 8/2016 Faith ..... H01R 12/70
9,478,884 B2 * 10/2016 Tsai ..... H01R 12/724
9,538,637 B2 * 1/2017 Zhao ..... H05K 1/115
9,590,737 B2 * 3/2017 Tang ..... G02B 6/4292
9,620,894 B2 * 4/2017 Potterf ..... H01R 12/7076
9,703,053 B2 * 7/2017 Kagaya ..... G02B 6/4215
9,711,901 B2 * 7/2017 Scholeno ..... G02B 6/4284
9,711,908 B2 * 7/2017 Yao ..... H01R 12/724
9,810,873 B2 * 11/2017 McColloch ..... G02B 6/42
9,819,125 B2 * 11/2017 Regnier ..... H01R 24/62
9,831,610 B2 * 11/2017 Sutter ..... H01R 24/62
9,882,314 B2 * 1/2018 Casher ..... H01R 12/724
10,193,268 B1 * 1/2019 Chow ..... H01R 13/516
10,320,482 B2 * 6/2019 Chou ..... H04B 10/2503
2003/0020986 A1 * 1/2003 Pang ..... G02B 6/4246 398/139
2005/0152701 A1 * 7/2005 Liu ..... H05K 9/0058 398/135
2007/0049100 A1 3/2007 Tsai
2007/0059953 A1 * 3/2007 Togami ..... G02B 6/4292 439/76.1
2007/0072457 A1 * 3/2007 Hamazaki ..... H01R 12/721 439/108
2007/0110374 A1 * 5/2007 Oki ..... G02B 6/4256 385/89
2007/0237464 A1 * 10/2007 Aronson ..... G02B 6/4416 385/89
2008/0112674 A1 * 5/2008 Andersson ..... G02B 6/4292 385/92
2008/0145003 A1 * 6/2008 Ice ..... G02B 6/4292 385/92
2009/0180784 A1 * 7/2009 Kagaya ..... G02B 6/4201 398/164
2010/0029104 A1 * 2/2010 Patel ..... H01R 13/6592 439/76.1
2010/0061069 A1 3/2010 Cole
2010/0087084 A1 * 4/2010 George ..... H01R 13/6275 439/352
2012/0220152 A1 8/2012 Wu
2012/0251057 A1 10/2012 Yi et al.
2012/0281365 A1 11/2012 Lima
2013/0005178 A1 1/2013 Straka et al.
2013/0156418 A1 * 6/2013 Stapleton ..... G02B 6/4283 398/25
2014/0348468 A1 * 11/2014 Lagziel ..... G02B 6/4292 385/78
2014/0349496 A1 * 11/2014 Zhu ..... H05K 1/0219 439/108
2014/0363171 A1 * 12/2014 Tang ..... H01R 31/005 398/135
2015/0333460 A1 11/2015 Regnier et al.
2016/0131854 A1 * 5/2016 de Jong ..... G02B 6/3879 385/59
2016/0238805 A1 * 8/2016 McColloch ..... G02B 6/4257
2017/0077643 A1 * 3/2017 Zbinden ..... G02B 6/4268

FOREIGN PATENT DOCUMENTS

CN 102870027 A 1/2013
CN 104020535 A 9/2014
WO WO 2014113563 A1 * 7/2014 ..... H01R 24/62

* cited by examiner

PLUG MODULE SYSTEM

RELATED APPLICATIONS

This application claims priority to International Application No. PCT/US2016/015098, filed Jan. 27, 2016, which claims priority to U.S. Provisional Application No. 62/108,276, filed Jan. 27, 2015, which is incorporated herein by reference in its entirety.

TECHNICAL FIELD

This disclosure relates to the field of input/output (IO) connectors, more specifically to IO connectors suitable for use in high data rate applications.

DESCRIPTION OF RELATED ART

Input/output (IO) connectors that have four communication channels (e.g., 4 transmits and 4 receives) are known. One example is the quad small form-factor pluggable (QSFP) connector. These types of connectors are suited to support high bandwidth applications due to the inclusion of the four communication channels.

One issue that sometimes comes up with a connector such as the QSFP style connector is that there is a desire to have a large amount of bandwidth available on a switch that is positioned as a Top of Rack (ToR) switch but the bandwidth available in one QSFP port provided in such a ToR switch might be greater than another single port really needs. The desire to break out the channel sometimes existed in standard QSFP products that provided 40 Gbps and this desired is expected to become a more prevalent issue in products designed to support 100 Gbps, such as 100 Gbps capable QSFP products.

One existing way to address this issue is to have what is sometime referred to as a break-out cable or octopus cable. For example, a cable assembly could have a QSFP plug module on one end and have four cables extending from the QSFP plug to four separate small form-factor pluggable (SFP) style plug modules. This allows a single QSFP port to communicate with 4 SFP ports and, for high performing assemblies, each communication channel can support 25 Gbps of bidirectional communication. While this is an effective way to break out the four communication channels so as to allow one port to communicate with four other ports, the use of octopus cables is generally disfavored. One issue is that a cable from a ToR switch will have to reach lengths of less than a foot to more than a meter. As can be appreciated, it is difficult to know in advance how far each cable of an octopus cable assembly is going to need to reach. Therefore it is common to select a length that is long enough for all cases but is too long for most cases. This tends to result in a mess of cables that is difficult to understand or work with once installed. Consequentially, certain individuals would appreciate further improvements in connector configurations.

SUMMARY

A plug module is disclosed that includes a first mating end that is configured to mate with a predefined port (such as a conventional connector receptacle) and has a second mating end that includes a plurality of micro receptacles. A paddle card can be positioned at the first mating end and the micro receptacles can be supported so that they are offset upward, compared to the paddle card. A plurality of cable assemblies with micro plugs can be connected to the plurality of micro receptacles such that each cable assembly can offer a different length and have a desired far end termination configuration.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s), Therefore, unless otherwise noted, features disclosed herein may be combined together to form additional combinations that were not otherwise shown for purposes of brevity.

As can be appreciated from the Figures, a plug module 10 is depicted and as depicted can result in a quad small-form factor pluggable (QSFP) module. Thus, the depicted embodiment allows for the insertion of the plug module 10 into an existing QSFP receptacle port and can provide four break out connectors. QSFP modules are fairly beneficial for Top of Rack (ToR) applications as well as many other applications that benefit from 4 channels of high-speed data. The features discussed herein, however, are not limited to use with QSFP style connectors as other sized plug receptacle could also provide similar functionality (with larger plug modules potentially supporting additional connectors).

Figure 1:
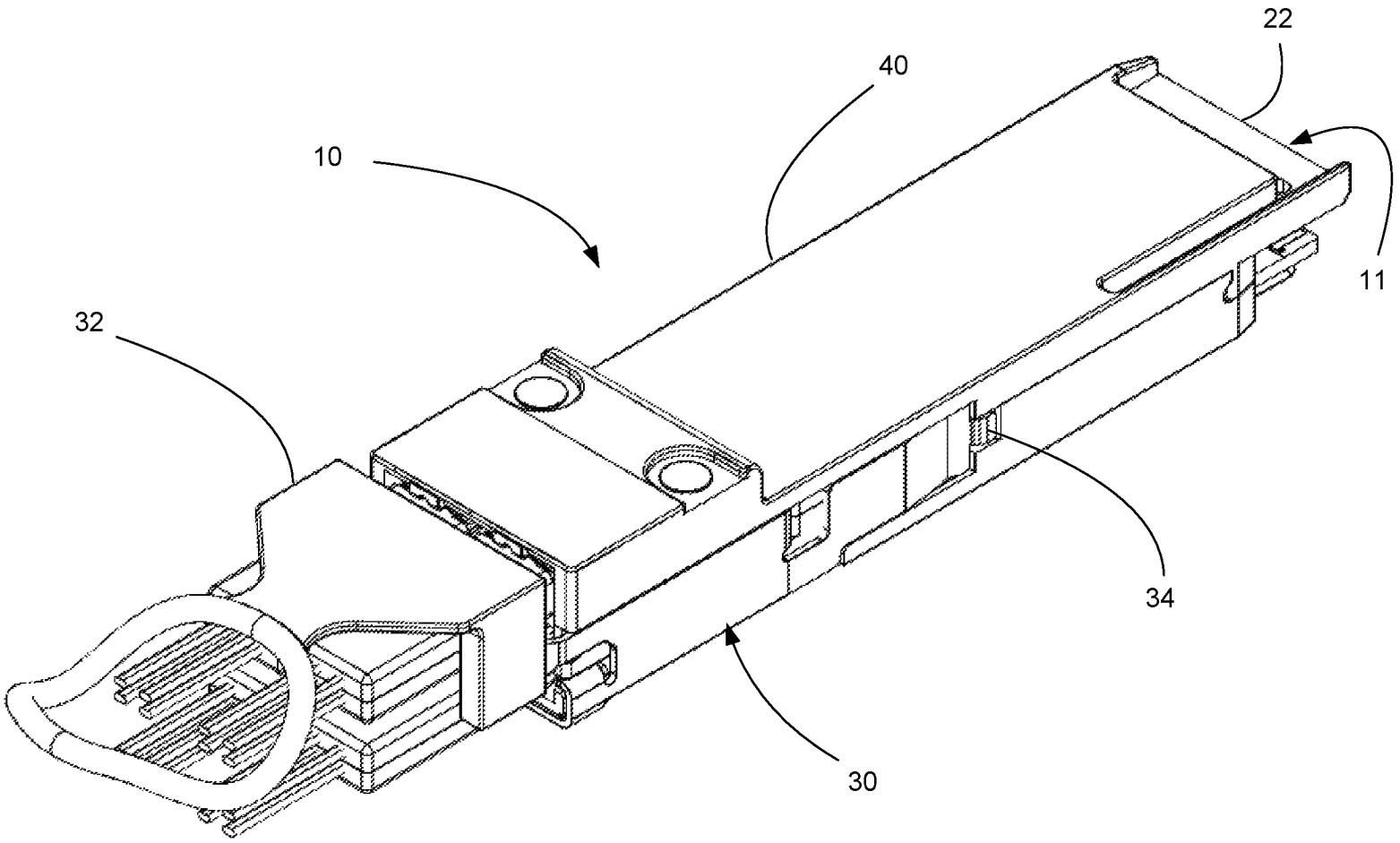
FIG. 1 illustrates a perspective view of an embodiment of a break out connector module.
Figure 2:
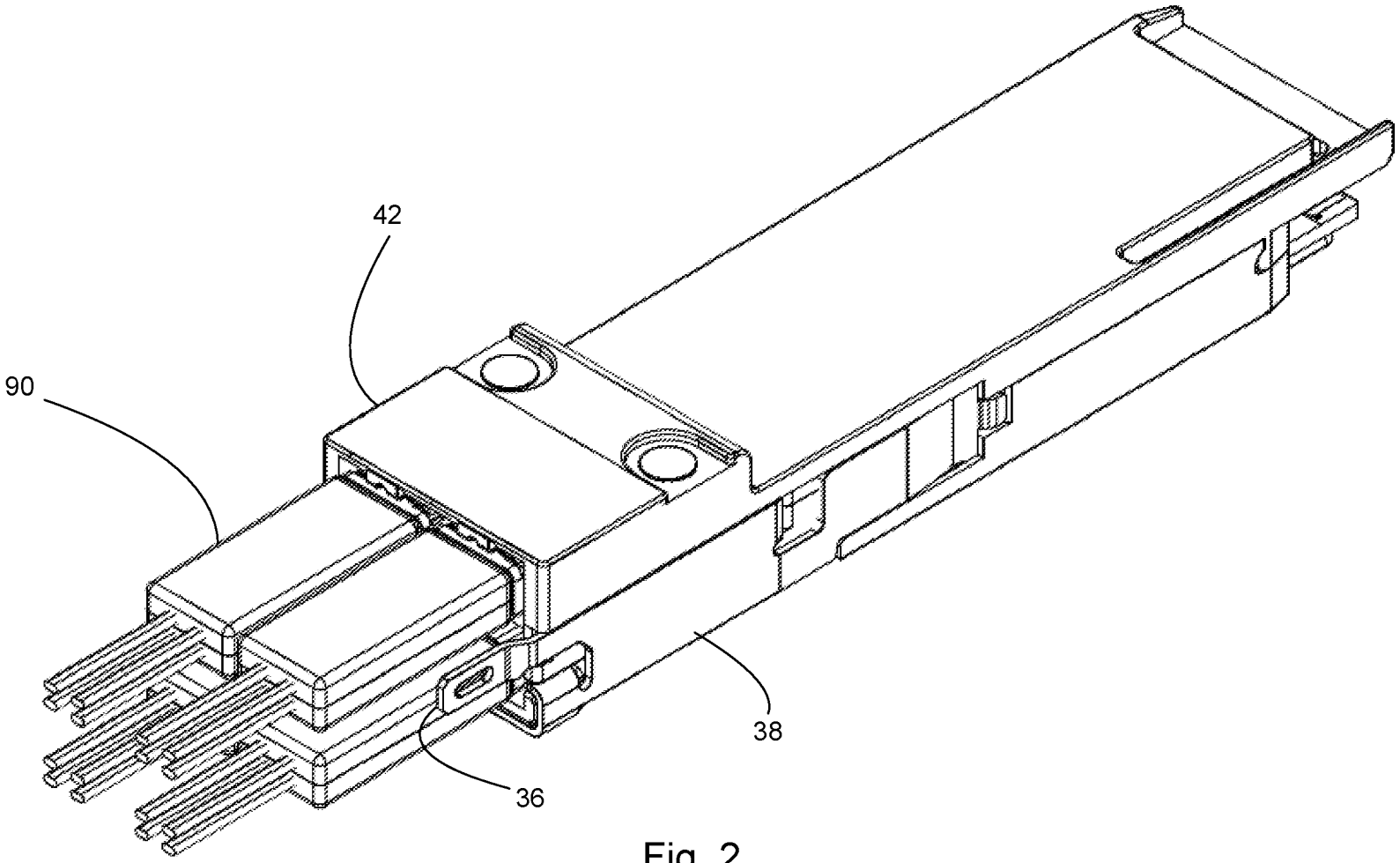
FIG. 2 illustrates a simplified perspective view of the embodiment depicted in FIG. 1.
Figure 3:
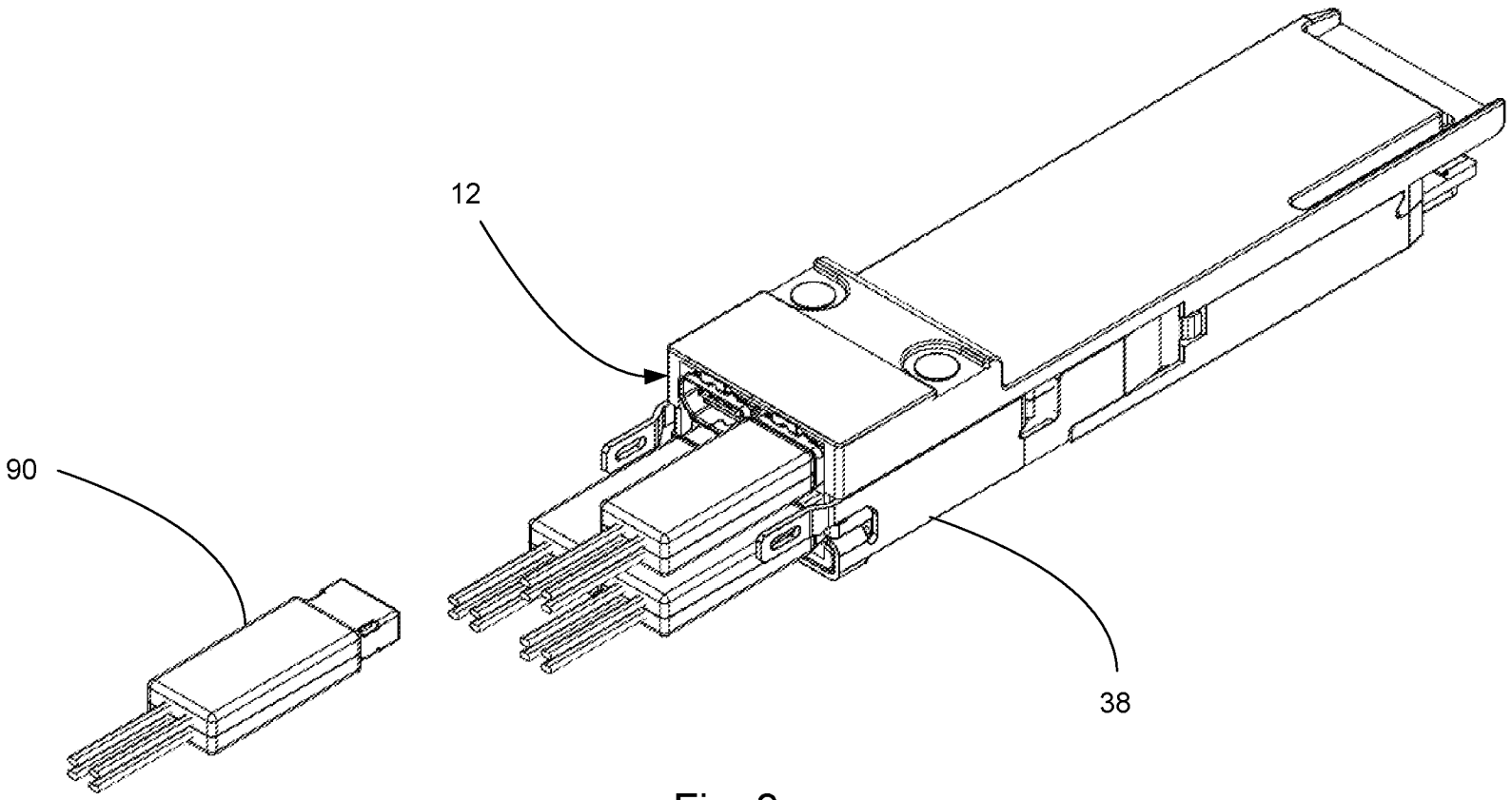
FIG. 3 illustrates a perspective, partially exploded view of the embodiment depicted in FIG. 2.
Figure 4:
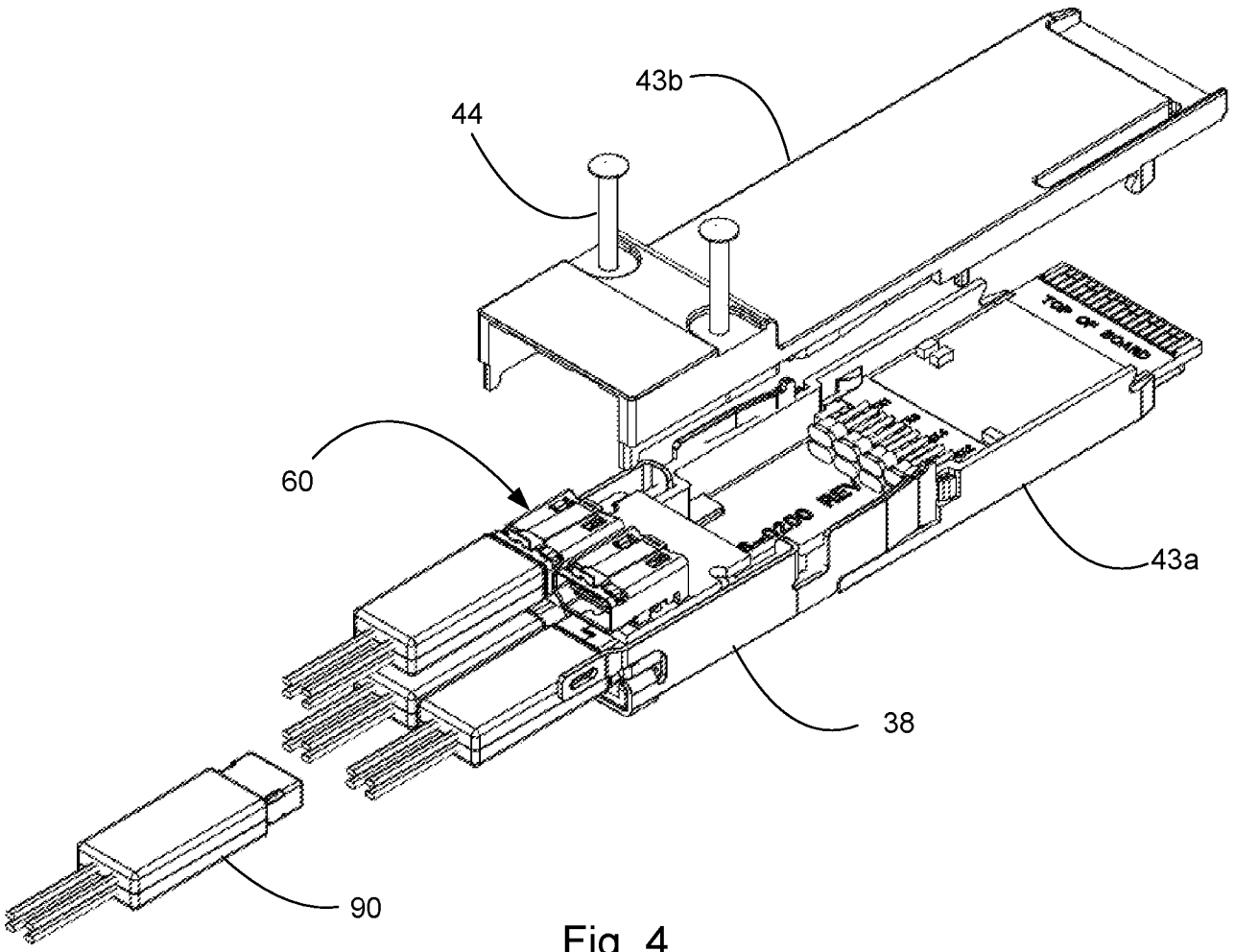
FIG. 4 illustrates an exploded perspective view of the embodiment depicted in FIG. 2.
Figure 5:
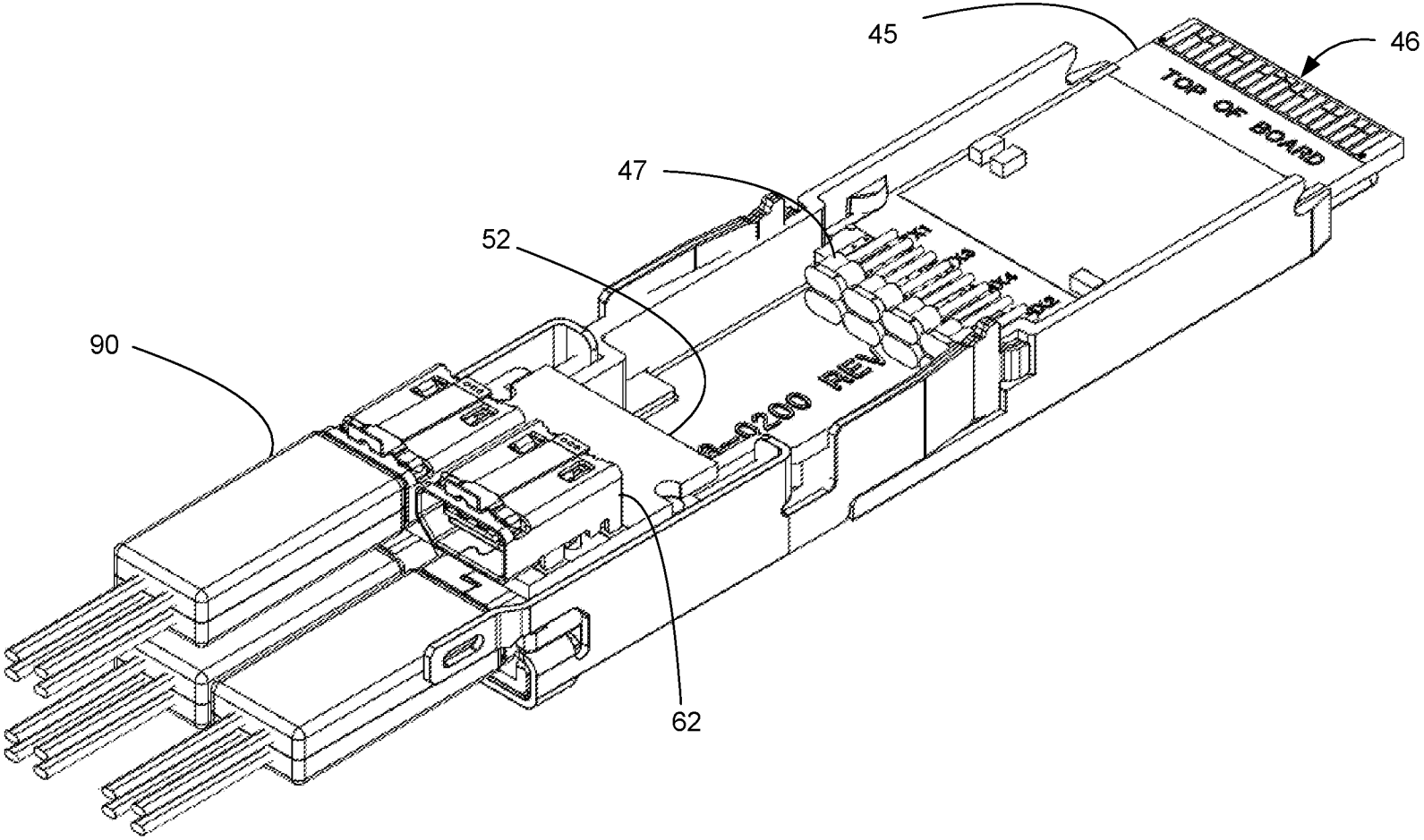
FIG. 5 illustrates a perspective simplified view of the embodiment depicted in FIG. 4.
Figure 6:
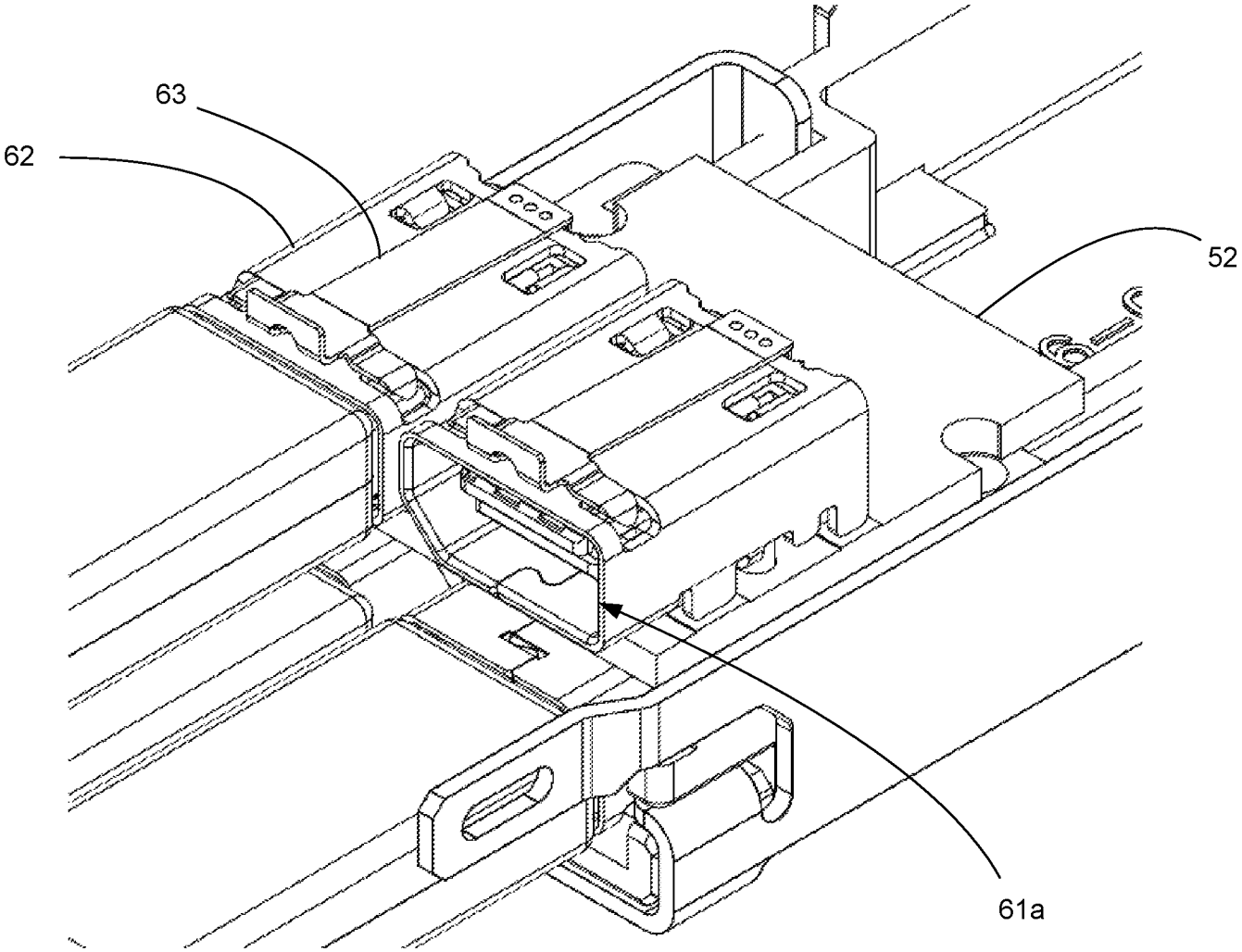
FIG. 6 illustrates a perspective enlarged view of the embodiment depicted in FIG. 5.
Figure 7:
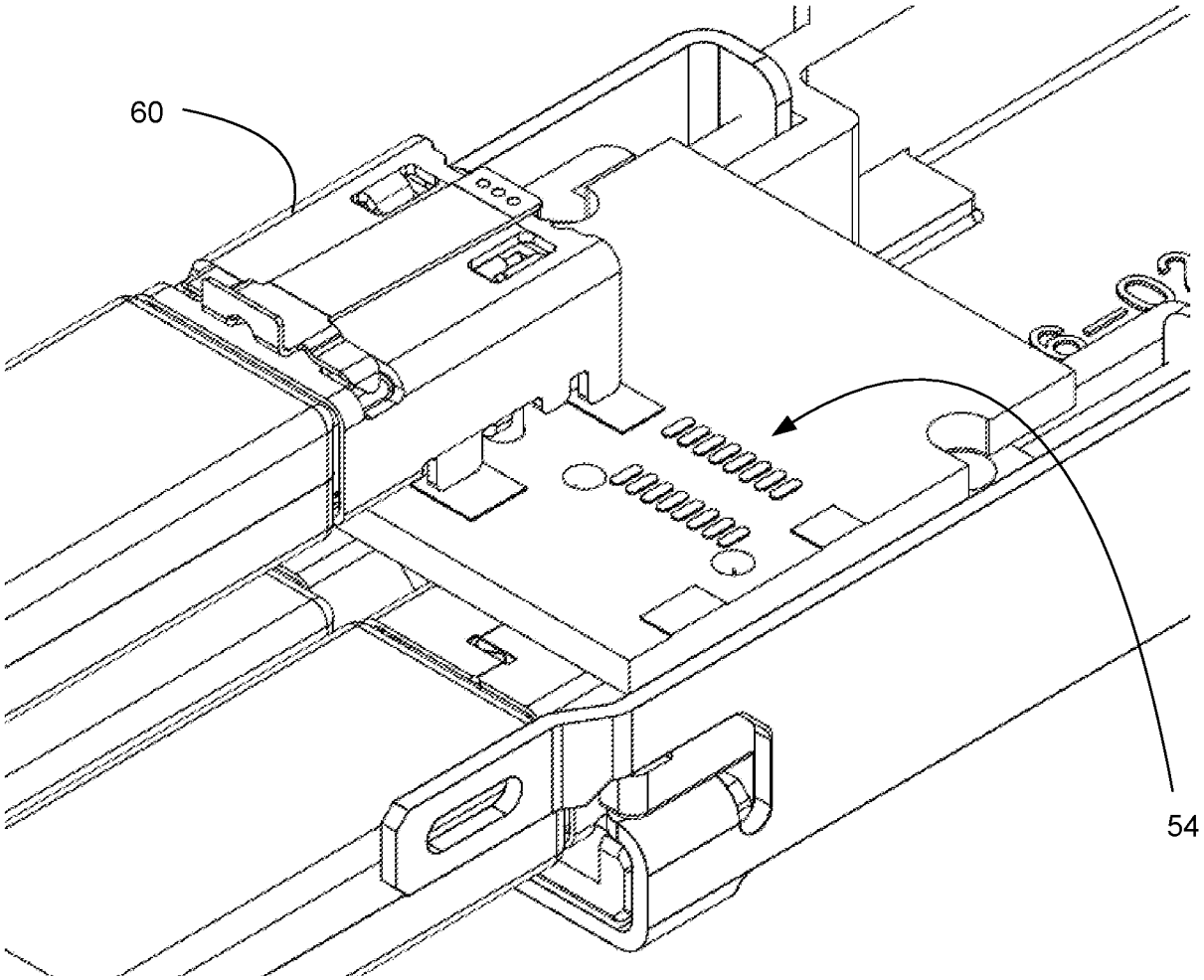
FIG. 7 illustrates a perspective simplified view of the embodiment depicted in FIG. 6.

The depicted plug module 10 includes a latch 30 with an optional pull-tab 32 that is removed in FIG. 2. As can be appreciated, the plug module has a body 40 formed of a lower half 43*a* and an upper half 43*b* that are secured together with fasteners 44 and the plug module 10 has a first mating end 11 and a second mating end 12 opposing the first mating end 11. In operation, the first mating end 11 is configured to mate with a receptacle (not shown but which could be a standard QSFP receptacle) and the second mating end 12 is intended to provide receptacles as discussed herein.

A paddle card 45 with contact pads 46 is provided on a first mating end 11 and the paddle card 45 is configured to mate with a corresponding connector (typically one that includes a card slot). Four micro receptacles 60 are provided at the second mating end 12 and each micro receptacle 60 includes a mating face 61*a* and a rear face 61*b*. While such data rates are not required, the micro receptacles 60 mounted in the plug module 10 can each support a two-way 25 Gbps channel with a design that provides one transmit pair and one receive pair (both configured to operate at 25 Gbps using NRZ encoding) with a total of 16 pins while being less than 7 mm wide. It should be noted that the depicted plug module 10 is configured as a QSFP style plug module and thus is intended to mate with a receptacle that supports four two-way channels (e.g., with a 4× receptacle) and thus it makes sense to break out the one 4× into four 1× connectors. Do to size constraints, the micro receptacles 60 have less pins than a typical SFP connector would have but for many applications the 16 pins are sufficient. It should be noted that if the plug module was configured to engage a 2× receptacle then two 1× connectors would be sufficient from a break out standpoint and the design of the plug module could be so modified.

Each micro receptacle 60 is supported on a micro board 52 and includes a cage 62 and a latch 63. The latch 63 ensures that a mating micro plug connector 90 is securely fastened to the micro receptacle 60 and is not going to fall out do to vibration and inadvertent application of force to the micro plug connector 90. It should be noted that the depicted design includes a cable 47 (shown in truncated manner) that connects the paddle card 45 to the micro board 52. For purposes of illustration the termination of the cable 47 to the micro board 52 is omitted as such a termination is known and can be substantially the same as the termination shown on the paddle card 45. As is discussed, such a configuration is not required but it has been determination that such a configuration is desirable because it allows the micro board 52 to be offset upward compared to the paddle card 45. It turns out that offsetting the micro receptacles upward compared to the paddle card 45 is beneficial for users and it can help make it easier to package the plug module in a given system. Alternative embodiments could use flex circuitry to connect the micro receptacles 60 to the paddle card 45 and still provide the offset configuration. Other alternative embodiments that provide the optional offset configuration could include the use of a non-planar circuit board but in general a circuit board tends to be more lossy than a cable so care is needed to ensure the selected configuration is compatible with the signaling frequency and loss budget.

The micro receptacles 60 provide a micro port 65 that is defined by the cage 62 (preferably formed of a metal) that extends around a tongue 73 of a housing 70 that is formed of an insulative material. The housing 70 supports the terminals 80. In an embodiment the housing can be formed of a first wafer housing 71*a* and a second wafer housing 71*b*, where the first and second water housings 71*a*, 71*b* are each insert molded around a row of terminals such that corresponding contacts 80*a* are supported on a first tongue half 73*a* and a second tongue half 73*b*.

As can be appreciated, the micro receptacles 60 are configured as right-angle SMT style connectors with terminal sets 68 that each provide a row of terminals and are intended to be mounted on a pad array 54 on the micro board 52. In an embodiment the terminal sets 68 can have terminals 80 on a 0.5 mm pitch. Each of the terminals 80 includes a contact 80*a*, a tail 80*b* and a body 80*c* that extend therebetween. As can be appreciated, the tails 80*b* can be provided in two rows. Naturally, the mating micro plug connector 90 has mating terminals that are also arranged at a 0.5 mm pitch. In spite of the small size, the far end crosstalk can be more than 35 dB down and preferably can be more than 40 dB down out to 12.5 GHz signaling frequency.

Figure 21:
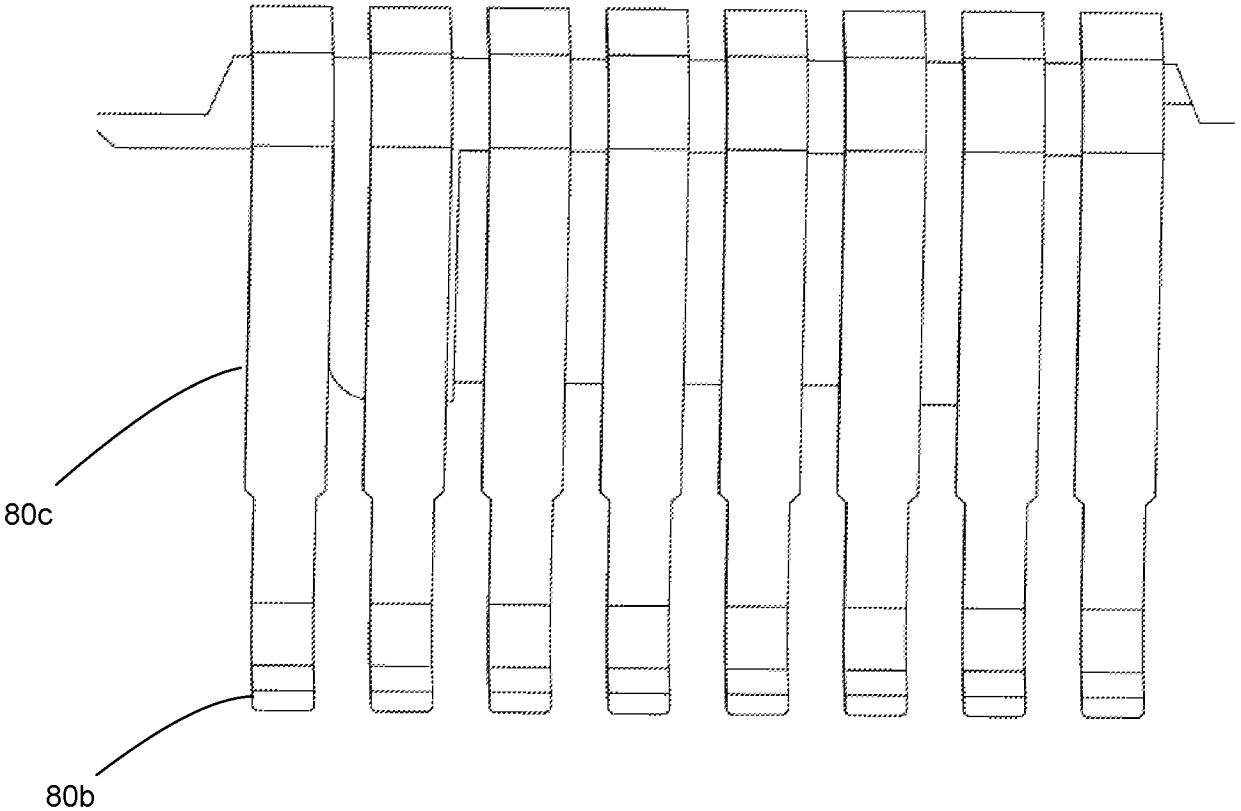
FIG. 21 illustrates an elevated rear view of a portion of an embodiment of a terminal set, showing an embodiment of uniform construction of the terminals.
Figure 22:
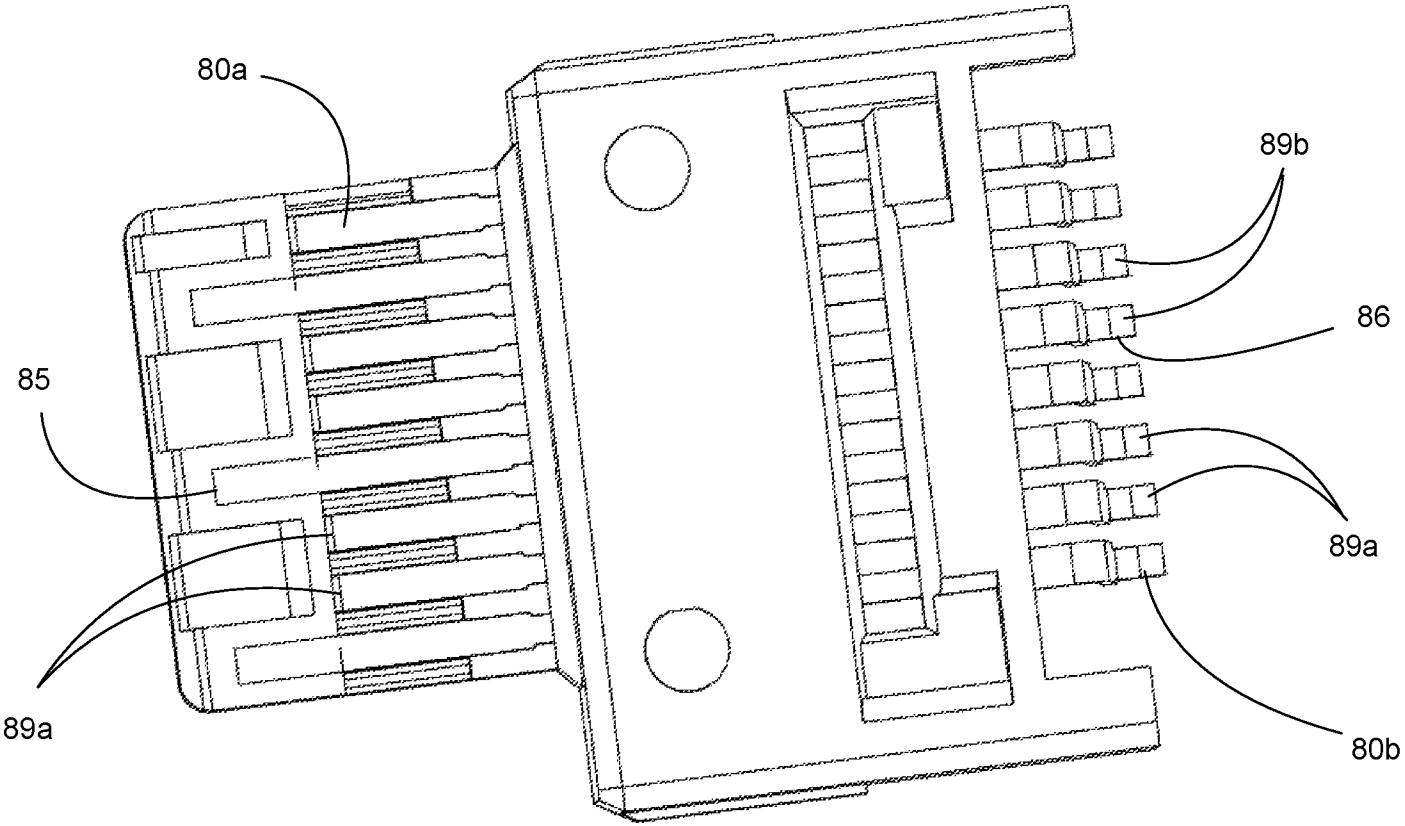
FIG. 22 illustrates a perspective simplified view of an embodiment of a first housing wafer with a terminal block removed.

To help provide the desirable performance, one of the rows of terminals can include signal terminals 86 (that form differential signal pairs 89*a*, 89*b*) spaced apart by a ground terminal 85 and in an embodiment the tongue and contact configuration can be adjusted so that the ground terminals 85 extends past the signal terminals 86 and notches 74*a*, 74*b* are provided in the first and second tongue halves 73*a*, 73*b* where the corresponding notch is placed at the end of the signal terminals 86 that form the differential pair. While such an optional configuration is not required, it has been determined that for a compact design as depicted it is beneficial to have the notches 74*a*, 74*b* as depicted so as to improve the tuning of the terminals. The notches 74*a*, 74*b*, in combination with tuning apertures 77, can be arranged so that the signal terminals are preferentially coupled (e.g., more signal energy travels on the signal terminals than would normally travel on a symmetric configuration). This can be done by modifying the dielectric constant of the structure surrounding the signal terminals so that they are more tightly coupled together than one of the signal terminals is coupled to an adjacent ground terminal. As can be appreciated from FIG. 21, however, in an embodiment the spacing and construction of the terminals can be symmetric in that the space between ground and signal terminals, along with the shape of the terminals, is substantially the same along the body and tail sections.

As depicted, the first wafer half 71*a* includes a terminal block 82 that attaches to a projection 81 via a receiving channel 84. The terminal block 82, while it can be integrated into the first wafer half 71*a*, is preferably separate and provides a terminal comb 83 that helps control the location and spacing of the tails. The second wafer half 71*b* can be an integral unit, as is depicted.

One issue that exists is the inclusion of the latch 63. As can be appreciated, there is very little space available and a latch that could be operated without a tool would be difficult to package. For certain applications a latch may not be required. However, for server applications and any applications where there is a need for a robust configuration that is resistant to accidental disengagement of a connector, a latch is needed. While it is common to place the latch on the plug module, the micro plug modules are so small and the space is so tight when they are arranged as depicted that providing a latch on the micro plugs is not feasible. As a result, Applicants have determined that the latch 63 can be provided on the micro receptacle 60.

Figure 8:
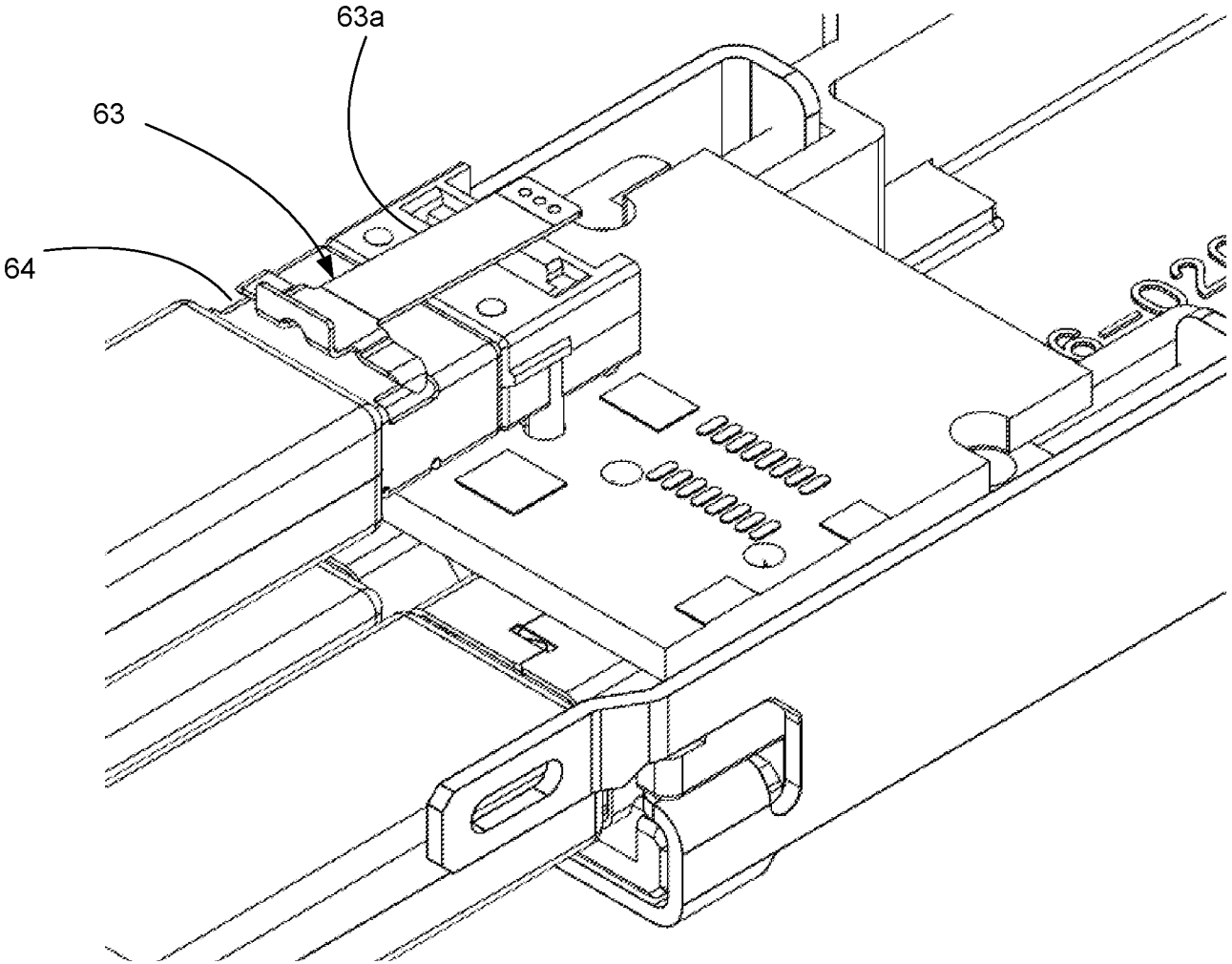
FIG. 8 illustrates a perspective view of the embodiment depicted in FIG. 7.
Figure 9:
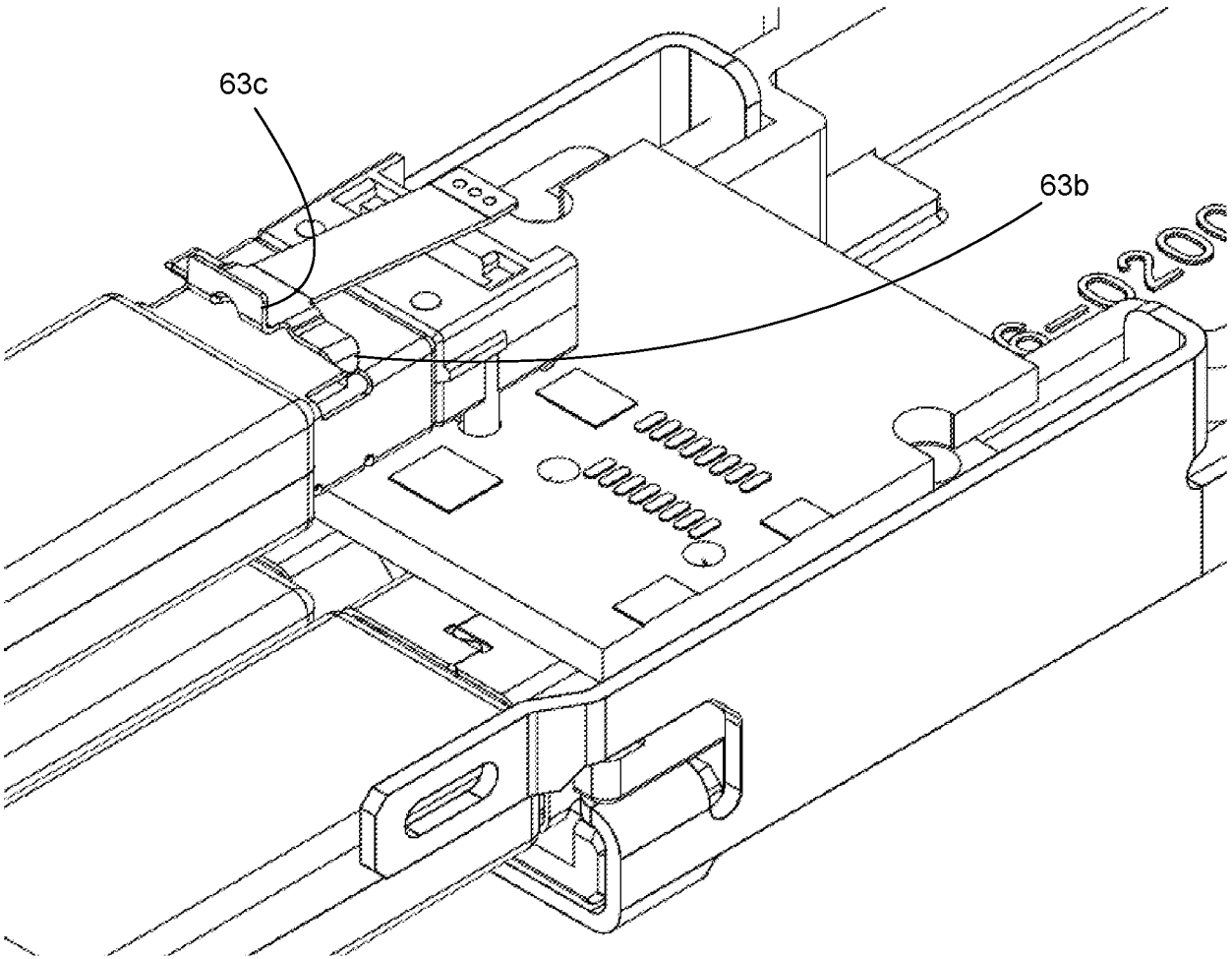
FIG. 9 illustrates a perspective view of the embodiment depicted in FIG. 8 but with a latch in a second position.
Figure 10:
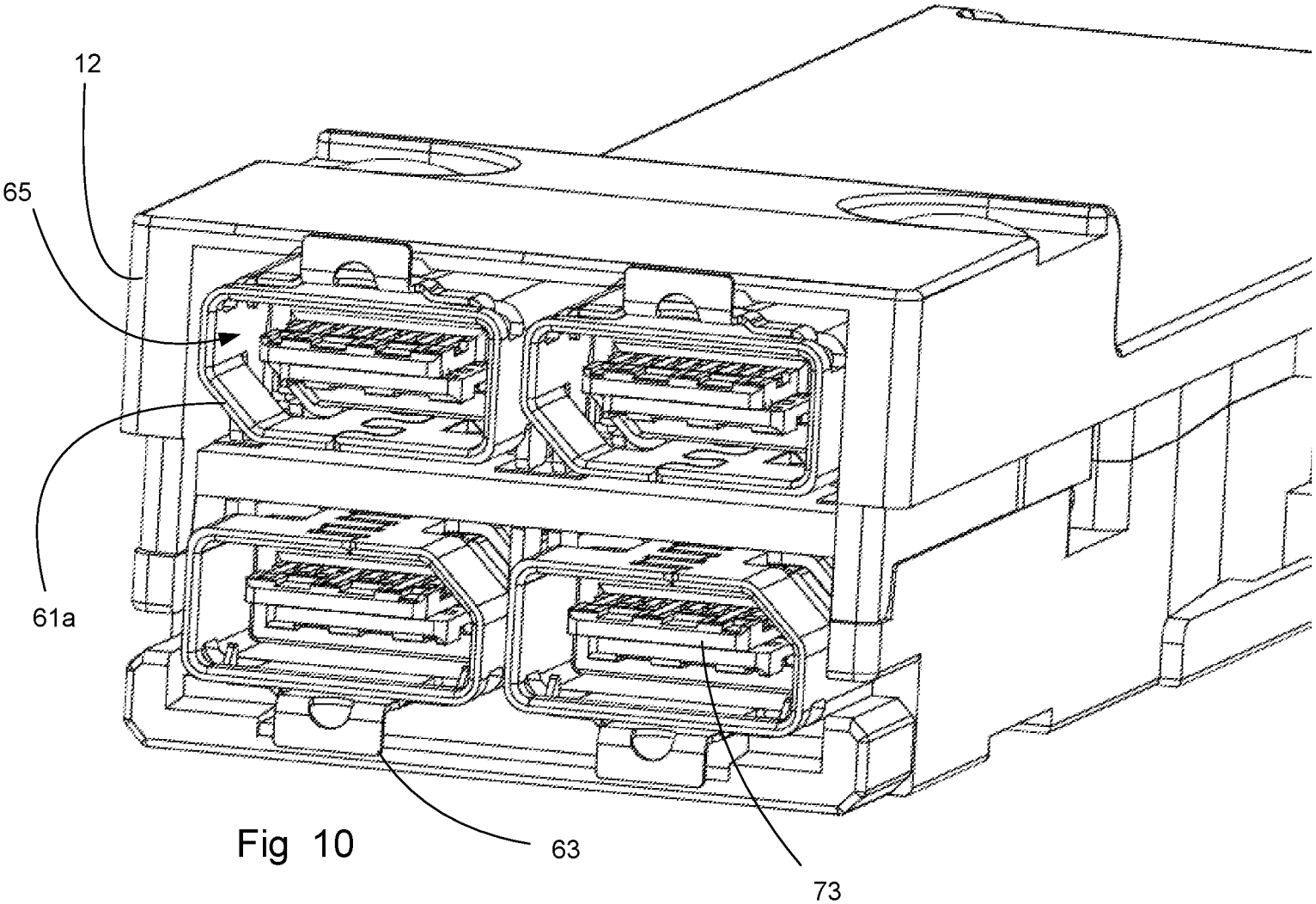
FIG. 10 illustrates a perspective view of an embodiment of a break out module with the latch system removed.
Figure 11:
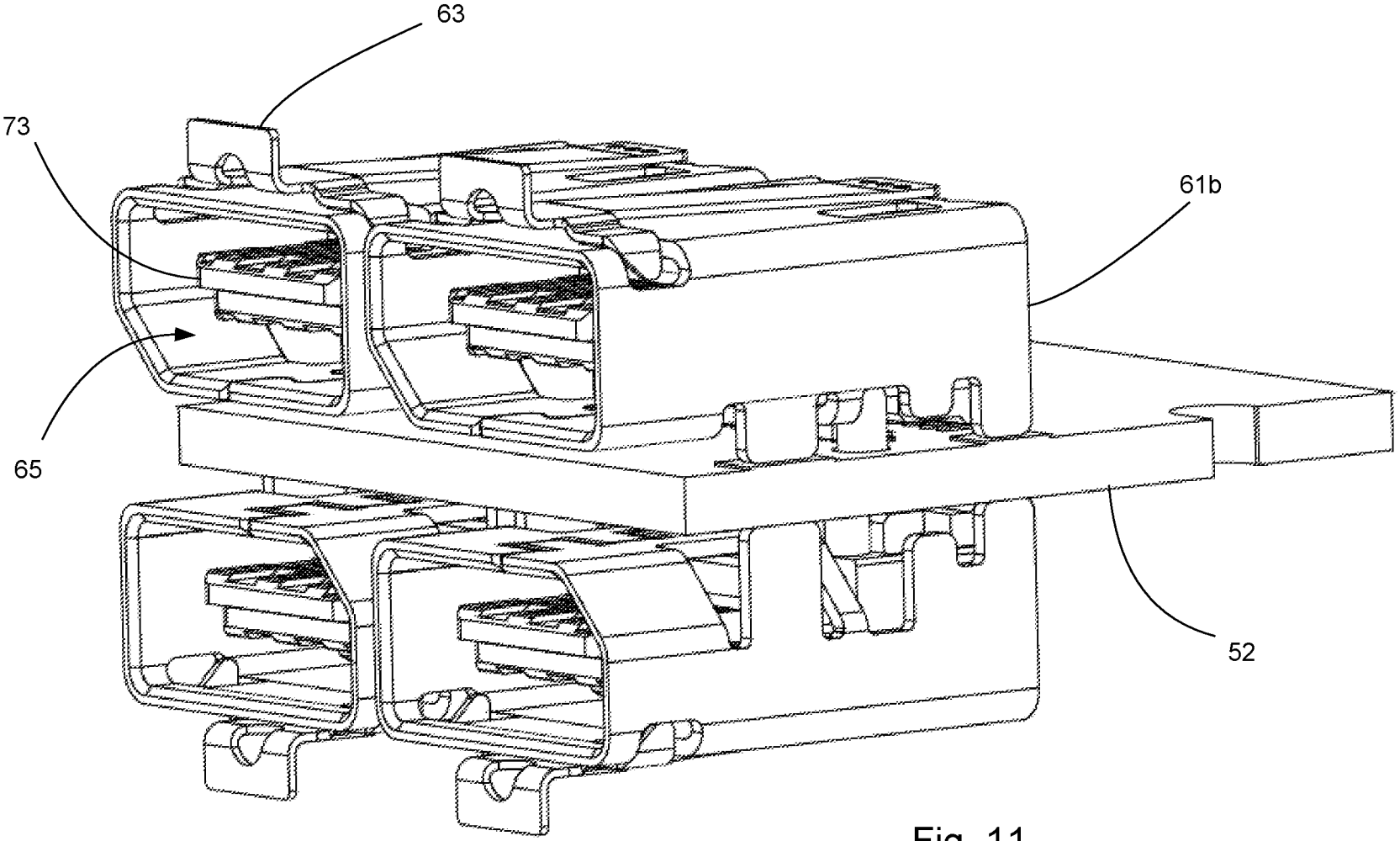
FIG. 11 illustrates a perspective view of an embodiment of a circuit board supporting four connectors.
Figure 12:
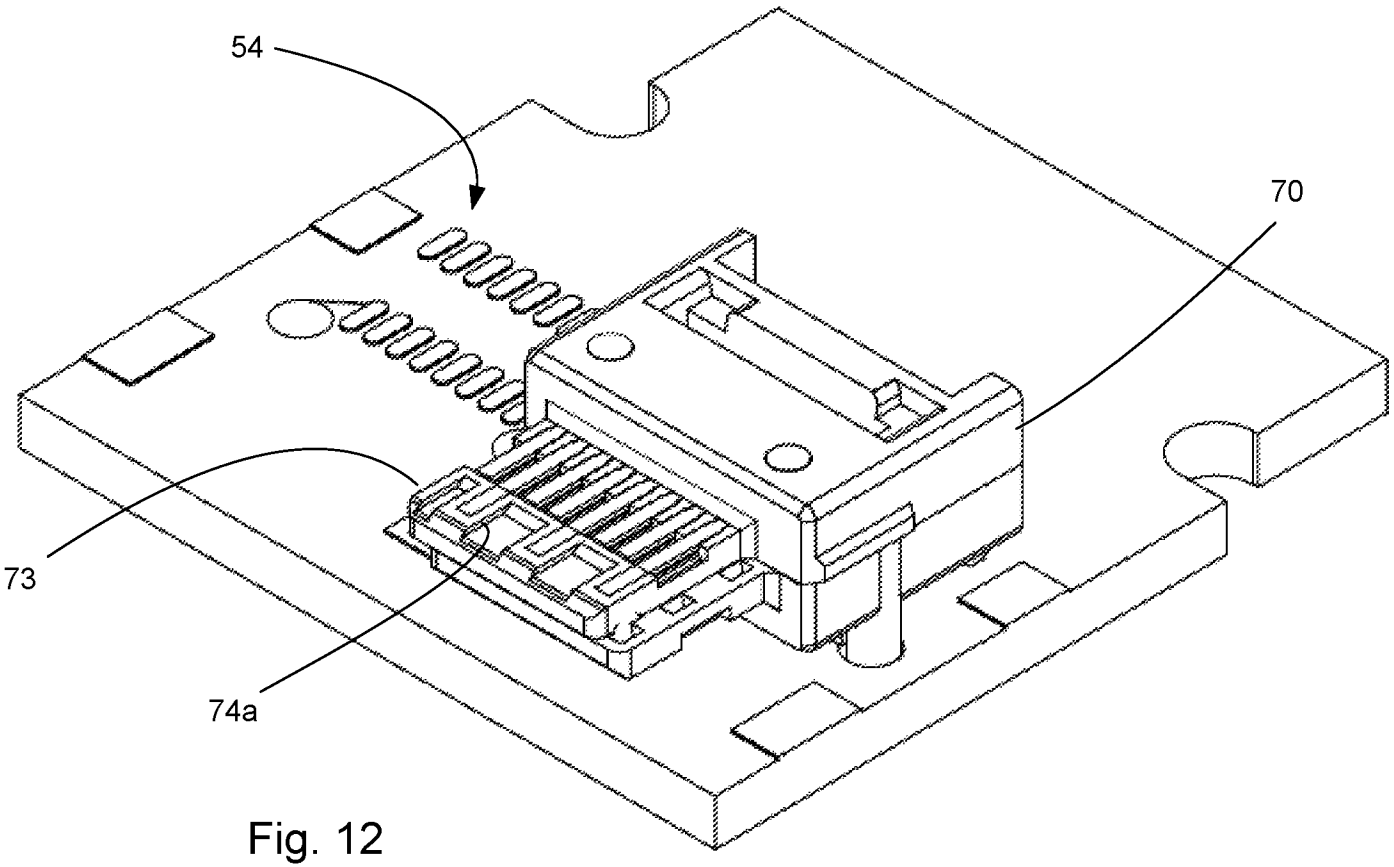
FIG. 12 illustrates a perspective simplified view of the embodiment depicted in FIG. 11 with just one connector housing positioned on the circuit board.
Figure 13:
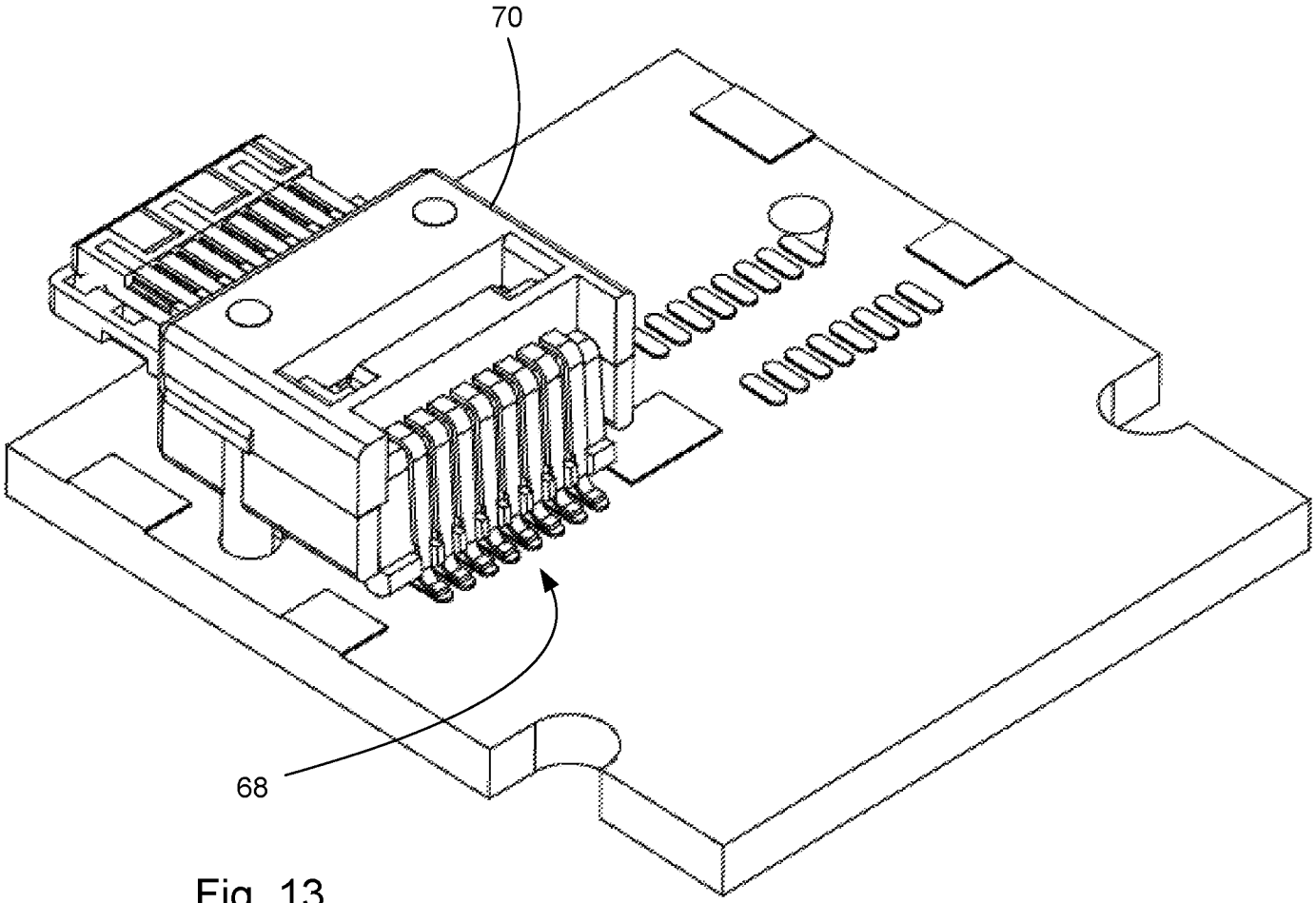
FIG. 13 illustrates another perspective view of the embodiment depicted in FIG. 12.
Figure 14:
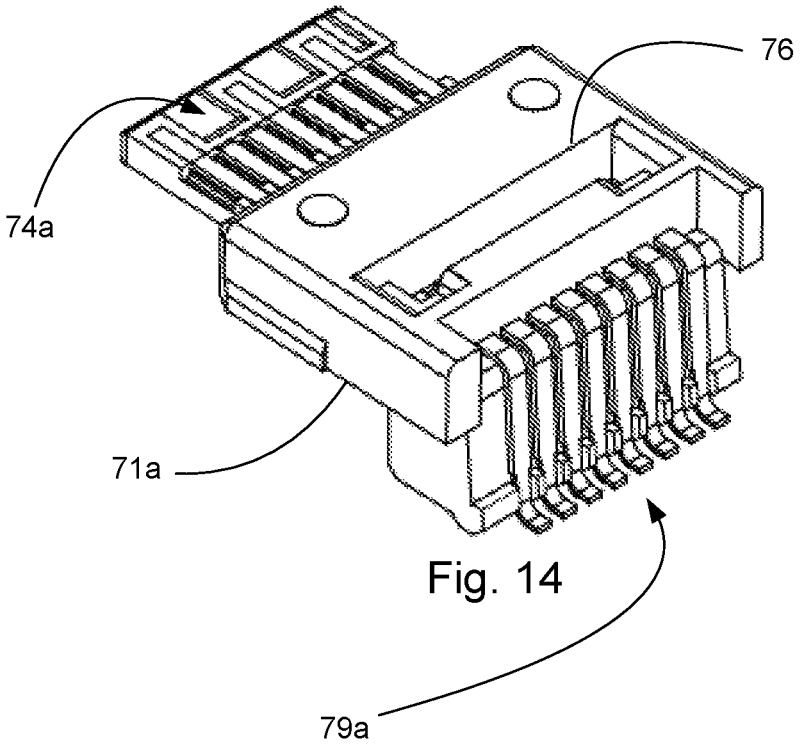
FIG. 14 illustrates a perspective view of an embodiment of a first housing wafer.
Figure 15:
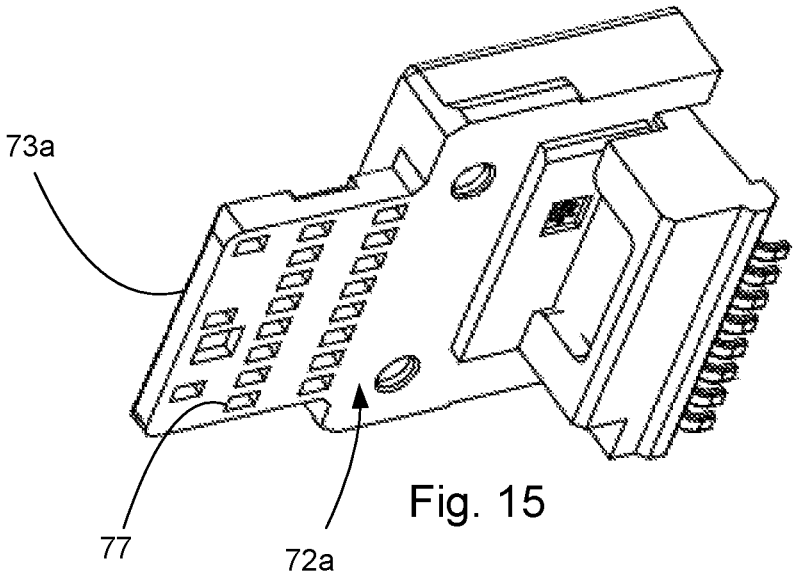
FIG. 15 illustrates another perspective view of the embodiment depicted in FIG. 14.
Figure 16:
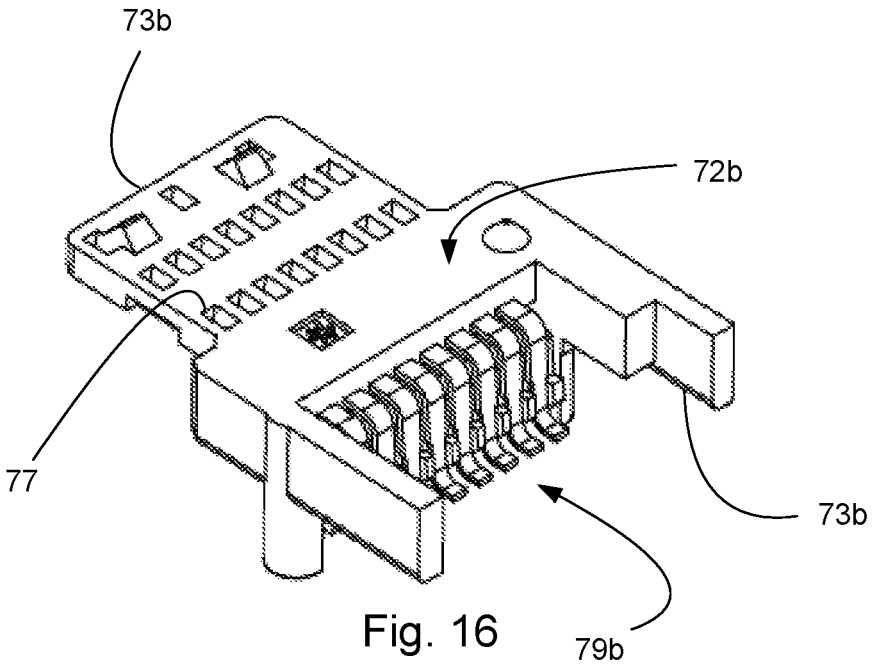
FIG. 16 illustrates a perspective view of an embodiment of a second housing wafer.
Figure 17:
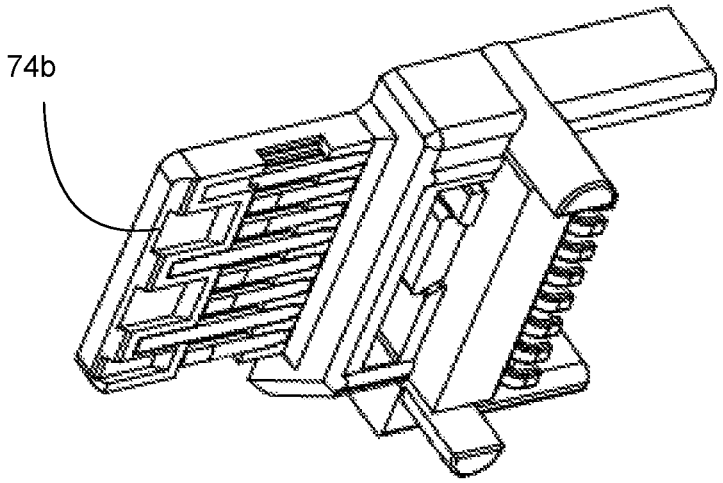
FIG. 17 illustrates another perspective view of the embodiment depicted in FIG. 16.
Figure 18:
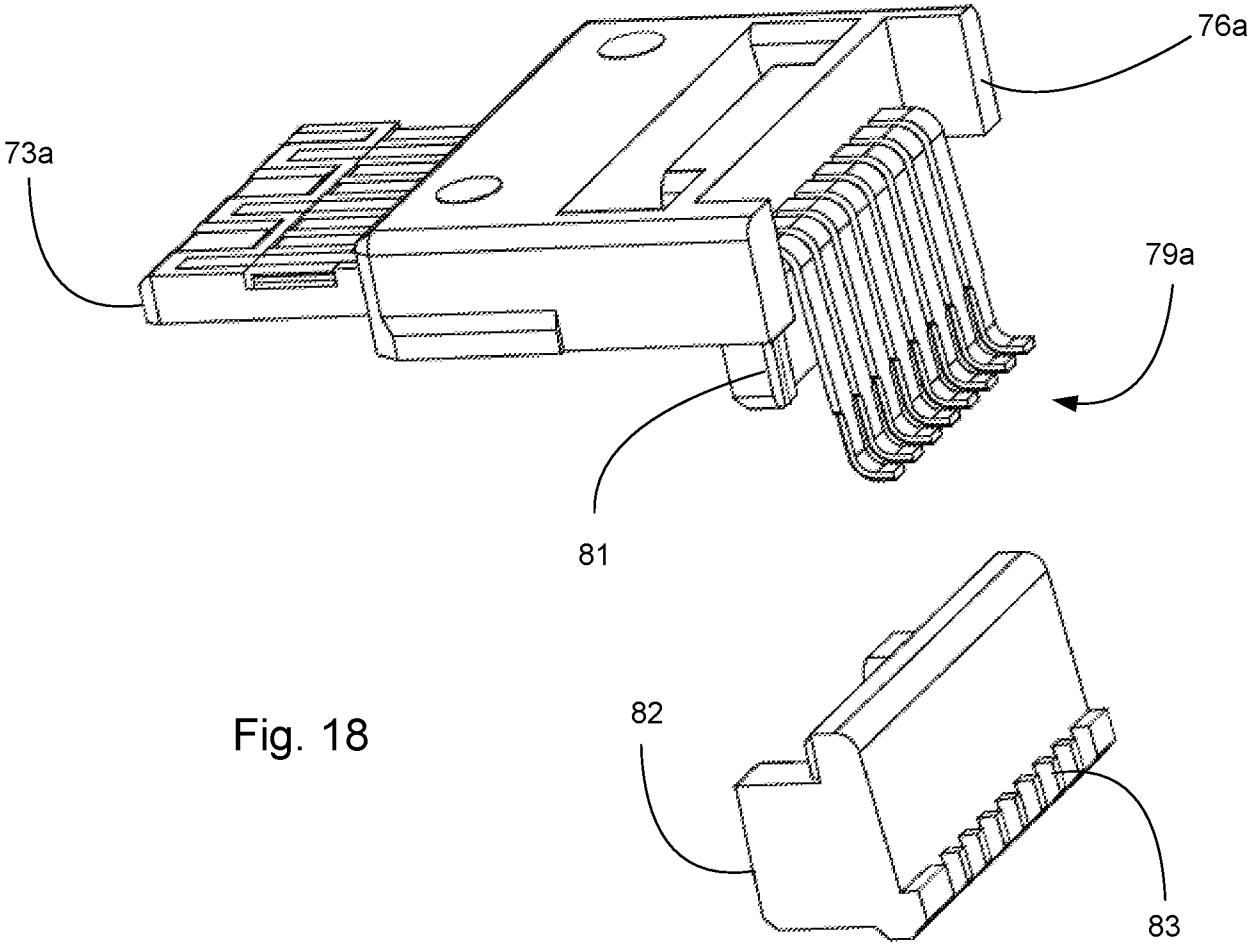
FIG. 18 illustrates a perspective, partially exploded view of an embodiment of a first housing wafer.
Figure 19:
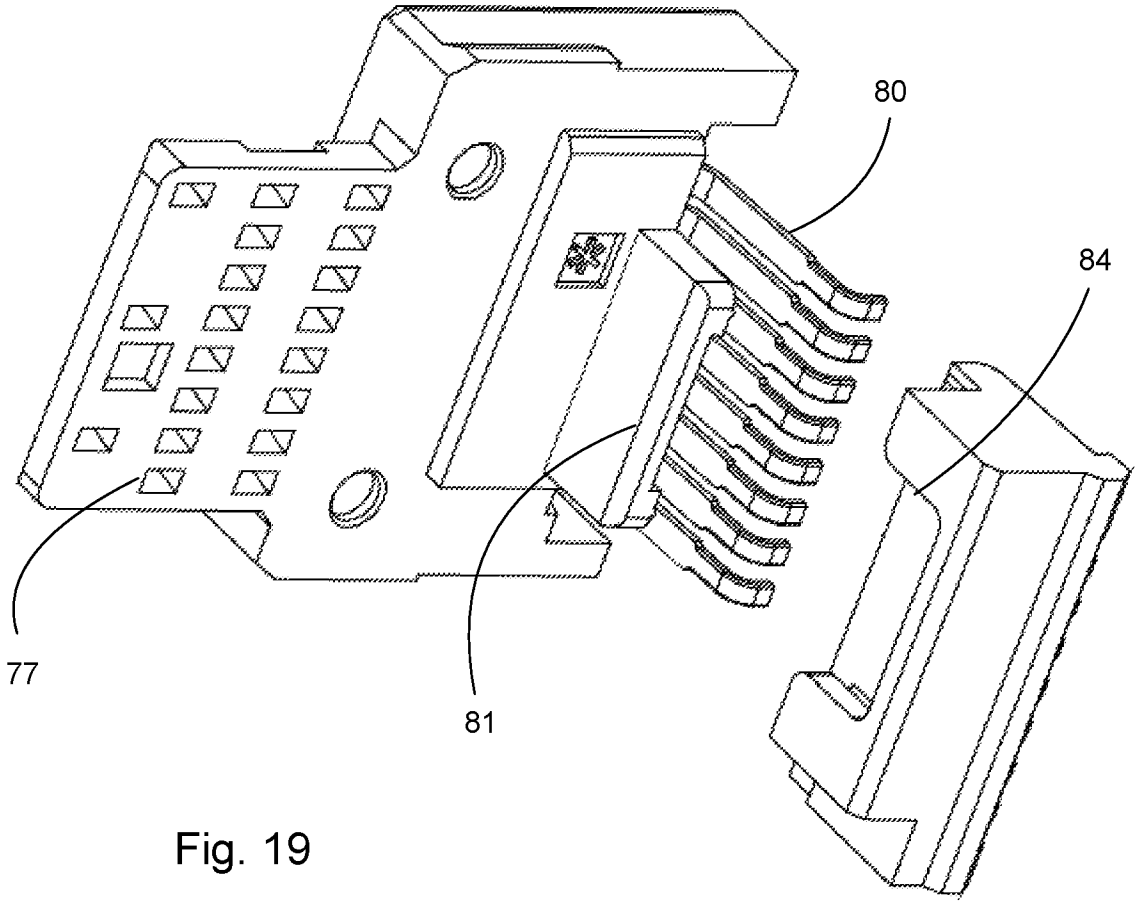
FIG. 19 illustrates another perspective view of the embodiment depicted in FIG. 18.
Figure 20:
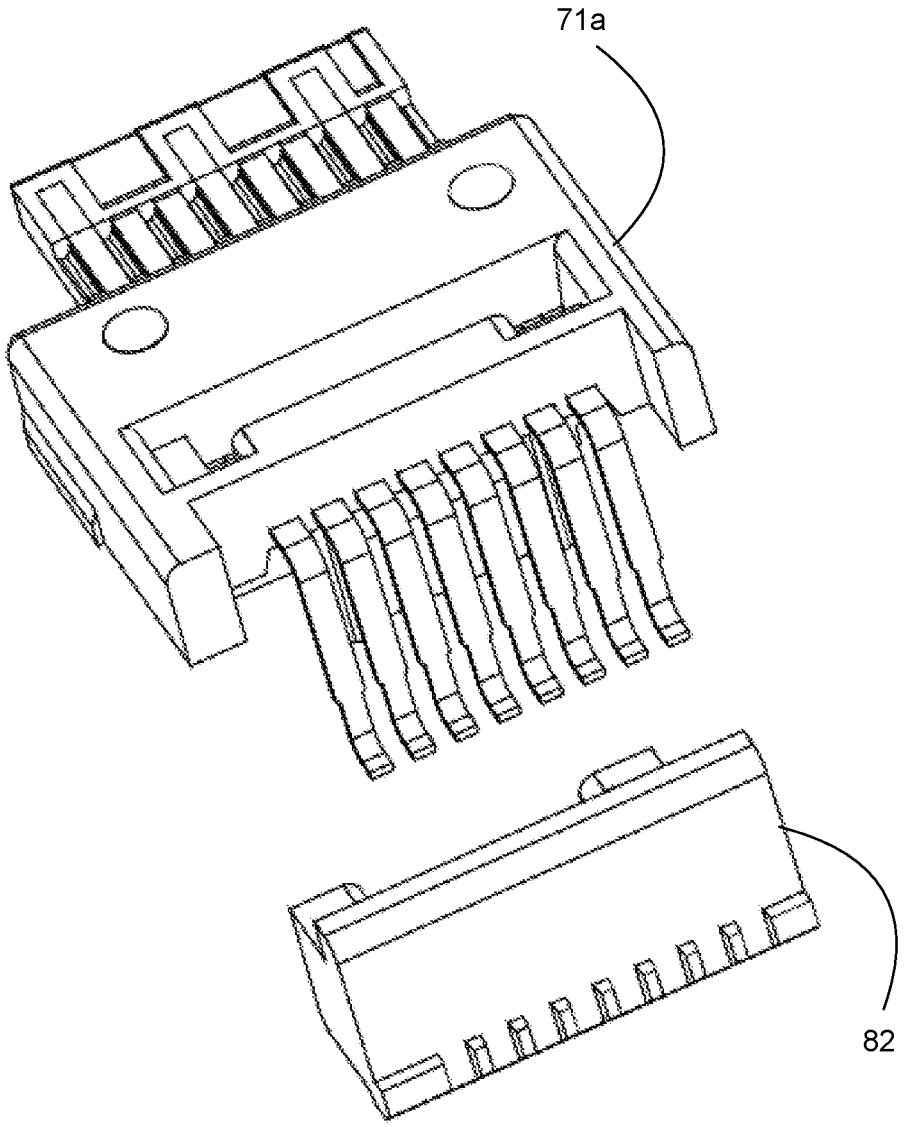
FIG. 20 illustrates another perspective view of the embodiment depicted in FIG. 18.

The depicted system therefore includes an optional latch 63 that is configured to retain a micro plug module that is inserted into the micro receptacle. The latch 63 includes a securing arm 63*a* that has one end secured to the cage 62 of the micro receptacle 60 and has retaining fingers 63*b* that extend through retaining apertures 64 in the cage 62 so that the retaining fingers 63*b* can engage the inserted plug connector and a release flange 63*c* is moveable with the use of a tool. In operation a tool can be inserted under the release flange 63*c* so as to cause the securing arm 63*a* to be translated upward. This will cause retaining fingers 63*b* on the securing arm 63*a* to disengage from retaining holes in the micro plug and the micro plug can then be removed. The translation of the securing arm 63*a* can be appreciated from the embodiments depicted in FIGS. 8 and 9. Naturally, if it is desirable to remove several micro plugs from a plug module 10 then it may be easier to first disconnect the plug module first and then remove the micro plugs.

As noted above, the micro receptacles 60 are mounted on a micro board 52. As depicted, the micro board 52 is separate from the paddle card 45. In an alternative embodiment the paddle card could be extended so that the micro board 52 and the paddle card 45 were integral or a single board and the micro receptacles 60 could be mounted directly on the paddle card 45 (and thus communicate via traces provided on the paddle card 45). Otherwise the micro board 52 and the paddle card 45 can be connected together in any desirable manner. It should be noted that if desired the plug module could also include circuitry such as a retimer and/or an amplifier to allow for improved operation.

Figure 23:
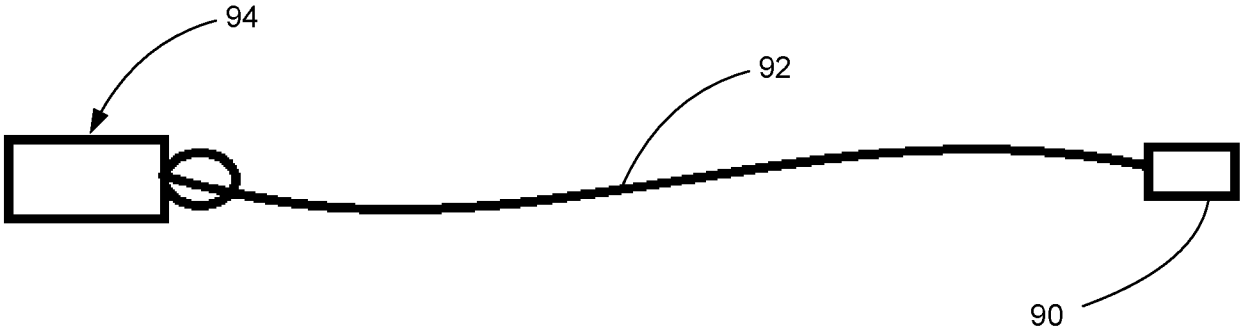
FIG. 23 illustrates a schematic representation of an embodiment of a cable assembly.

While active components can be added, it should be noted that the depicted configuration is intended to work as a passive system in certain applications. This is beneficial because the micro plug modules can be mounted on a cable assembly that has a different style connector on the opposite end. Thus the micro plug connector 90 could be provided on one end of a cable 92 and a conventional SFP style plug 94 could be placed on the other end (such as is depicted schematically in FIG. 23).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A plug module, comprising:

a body with a first mating end and a second mating end, the first end configured to be inserted into a predefined port;

a paddle card positioned in the first end and including a plurality of contact pads, the paddle card configured to receive at least two transmit channels and two receive channels;

a first micro receptacle and a second micro receptacle supported in the second mating end, wherein the first and second micro receptacle are each configured to include one of the two transmit channels and one of the two receive channels; and a micro board that supports the first and second micro receptacles, the first micro receptacle being mounted on the micro board and the second micro receptacle being mounted on the micro board.

2. The module of claim 1, wherein at least one cable connects the micro board to the paddle card.

3. The module of claim 1, wherein the micro receptacles are positioned on two sides of the micro board and the micro board is offset upward compared to the paddle card.

4. The module of claim 1, wherein each micro receptacle has at least 8 pins arranged on a 0.5 mm pitch.

5. The module of claim 1, wherein each micro receptacle includes an individual latch, each latch configured, in operation, to releasably engage a mating micro plug module.

6. A plug module system, comprising:

a plug module as defined in claim 5; and a cable assembly mated to the plug module, the cable assembly including a micro plug connector with terminals at a 0.5 mm pitch, wherein the micro receptacle and the micro plug connector are configured to support 12.5 GHz signaling over a transmit channel and a receive channel with less than 35 dB far end crosstalk.

7. The module system of claim 6, wherein the cable assembly has an SFP connector mounted on the other end.

8. The module system of claim 6, wherein a plurality of cable assemblies are mounted to the plug module, wherein one of the plurality of cable assemblies has a first length and another of the plurality of cables assembles has a second length, the first length being different than the second length.

9. The module of claim 1, wherein at least one cable electrically connects the paddle card to at least one of the first micro receptacle and the second micro receptacle.

10. The module of claim 9, wherein the at least one cable connects the paddle card to the at least one of the first micro receptacle and the second micro receptacle.

11. The module of claim 1, wherein flex circuitry electrically connects the paddle card to at least one of the first micro receptacle and the second micro receptacle.

12. The module of claim 1, wherein the micro board comprises a planar circuit board.

13. The module of claim 1, wherein the module further comprises circuitry that includes at least one of a retimer and an amplifier.

14. A plug module, comprising:

a body with a first mating end and a second mating end, the first end configured to be inserted into a predefined port;

a paddle card positioned in the first mating end and including a plurality of contact pads, the paddle card configured to receive at least two transmit channels and two receive channels;

a first micro receptacle and a second micro receptacle supported in the second mating end, wherein the first and second micro receptacle are each configured to include one of the two transmit channels and one of the two receive channels; and a micro board that supports the first and second micro receptacles, the first micro receptacle being mounted on a first side of the micro board and the second micro receptacle being mounted on a second side of the micro board, the first side of the micro board being opposite the second side of the micro board.

15. The plug module of claim 14, wherein at least one cable electrically connects the paddle card to at least one of the first micro receptacle and the second micro receptacle.

16. The plug module of claim 15, wherein the at least one cable connects the paddle card to the at least one of the first micro receptacle and the second micro receptacle.

17. The plug module of claim 14, wherein flex circuitry electrically connects the paddle card to at least one of the first micro receptacle and the second micro receptacle.

18. The plug module of claim 14, wherein the micro board comprises a planar circuit board.

19. The plug module of claim 14, wherein the plug module fluffier comprises circuitry that includes at least one of a retimer and an amplifier.

20. The plug module of claim 14, wherein each micro receptacle has at least 8 pins arranged on a 0.5 mm pitch.

* * * * *